United States Patent [19]

Wray et al.

[11] 3,964,305

[45] June 22, 1976

[54] APPARATUS FOR TESTING OIL WELLS

[75] Inventors: Gary Q. Wray; John C. Holden, both of Duncan, Okla.

[73] Assignee: Halliburton Company, Duncan, Okla.

[22] Filed: Feb. 19, 1974

[21] Appl. No.: 443,598

Related U.S. Application Data

[62] Division of Ser. No. 335,980, Feb. 26, 1973.

[52] U.S. Cl. ..... 73/151; 166/224 A

[51] Int. Cl.[2] ..... E21B 47/00

[58] Field of Search ..... 73/151, 155; 166/224 A

[56] References Cited

UNITED STATES PATENTS

| | | | |
|---|---|---|---|
| 3,664,415 | 5/1972 | Wray et al. | 166/.5 |
| 3,796,261 | 3/1974 | Nutter | 166/152 |
| 3,824,850 | 7/1974 | Nutter | 73/151 |
| 3,860,066 | 1/1975 | Pearce et al. | 166/224 A |

*Primary Examiner*—Jerry W. Myracle

*Attorney, Agent, or Firm*—John H. Tregoning; Floyd A. Gonzalez

[57] ABSTRACT

An annulus pressure operated oil well testing and sampling apparatus utilizes hydrostatic pressue to supplement spring means which biases against valve means to hold the valve means closed until application of sufficient hydraulic pressure to the annular fluid opens the tool to the formation and allows testing operations to be performed. A subsequent intentional or inadvertent release or sudden extreme increase of applied pressure on the annular fluid actuates means to close the valve means against further formation fluid flow.

9 Claims, 5 Drawing Figures

APPARATUS FOR TESTING OIL WELLS

BACKGROUND OF THE INVENTION

This is a division of application Ser. No. 335,980, filed Feb. 26, 1973.

This invention is directed towards testing of oil wells and is specifically advantageous in offshore and underwater wells.

After an oil well has been encased and cemented it usually becomes desirable to test the formations penetrated by the wellbore for possible production rates and general potential of the well. In doing so, a test string containing several different types of tools is utilized to determine the productivity of the well. These tools may include a pressure recorder, a sample chamber, a closed-in pressure tester, an hydraulic jar, one or more packers, a circulating valve, and possibly several other tools.

The testing procedure requires the opening of a section of the wellbore to atmospheric or reduced pressure. This is accomplished by lowering the test string into the hole on drill pipe with the tester valves and sample chamber closed to prevent entry of well fluid into the drill pipe. With the string in place in the formation, packers are expanded to seal against the wellbore or casing to isolate the formation to be tested. Above the formation the hydrostatic pressure of the well fluid is supported by the upper packer. The well fluid in the isolated formation area is allowed to flow into the drill string by opening the tester valve. Fluid is allowed to continue flowing from the formation to measure the ability of the formation to produce. The formation may then be "closed in" to measure the rate of pressure buildup. After the flow measurements and pressure buildup curves have been obtained, samples can be trapped and the test string removed from the well.

Previously the method used to open and close the necessary valves and chambers in the tool string involved physical manipulations of the string either in vertical reciprocation or rotational motion or a combination of both. Another method involved use of heavy bars or balls dropped down the string to actuate certain tools in the string.

All of these methods suffer the serious disadvantage of requiring movement of or within the drill pipe. This is especially disadvantageous in offshore drilling because of the danger of drill pipe separation or blowout during the period the blowout preventer rams are removed from the drillpipe during the manipulation of the string or dropping of objects down the pipe.

One means of operating tools in the testing string without manipulation of the pipe which has proven very successful involves the use of annulus pressure operated testing tools. Examples of these tools include the annulus pressure responsive (APR) safety sampler disclosed in U.S. Pat. No. 3,664,415, the APR disc valve disclosed in U.S. Pat. application Ser. No. 224,755 filed Feb. 9, 1972, now U.S. Pat. No. 3,779,263 and the APR circulating valve disclosed in U.S. Pat. application Ser. No. 288,187 filed Sept. 11, 1972, now U.S. Pat. No. 3,850,250 all assigned to the assignee of this application, Halliburton Company.

While this family of annulus pressure operated testing and sampling tools offers substantial advancements over the mechanically operated tools previously discussed, the present invention discloses a second generation APR tool having even further advantages over those of the first generation.

Use of the above-mentioned first generation APR tool string requires a fairly accurate knowledge, either empirical or calculated, of the bottomhole conditions in the well immediately prior to running the required tests. This is because the inert gas chamber in these tools which serves as a spring biasing means must be charged at a predetermined pressure and volume to offset the hydrostatic pressure and temperature at bottomhole and still retain sufficient springing action to allow the tool to operate in response to surface applications of hydraulic pressure on the annulus fluid and to close the tool upon release of the applied annulus pressure. In the case of fairly deep wells, this requires the charging of the inert gas spring chamber to extremely high pressures, on the order of 10,000 psi and above, on the ground before going in the hole, which pressures require extra thick chamber walls and other precautionary measures for safety's sake.

The present invention overcomes these disadvantages by providing a tool which can be charged with inert gas at a relatively low pressure level on the ground and then utilizes hydrostatic pressure to supplement this pressure as the tool travels down the borehole, so that when the APR tool reaches the bottom of the hole there will be sufficient pressure in the tool gas chamber to provide a springing action above the pressure established by hydrostatic forces and gas expansion due to the high temperature rise. As the tool is removed from the well, hydrostatic supplementary pressure is gradually removed from the tool.

The tool of this invention, in addition to serving as a testing tool and sampler, also operates as a safety valve in case the drill string parts or leaks or other emergency arises which takes the weight off of the string. The tool also provides a lock-closed feature which automatically closes the tool in case of a large pressure rise in the casing. Furthermore, it features a full-open drillpipe bore from ground surface to the sampler depth.

This invention achieves its objectives by the use of multiple floating piston means, and multiple gas chambers in conjunction with shuttle valves and pressure balanced valves.

DESCRIPTION OF THE PREFERRED EMBODIMENTS

Figure 1:
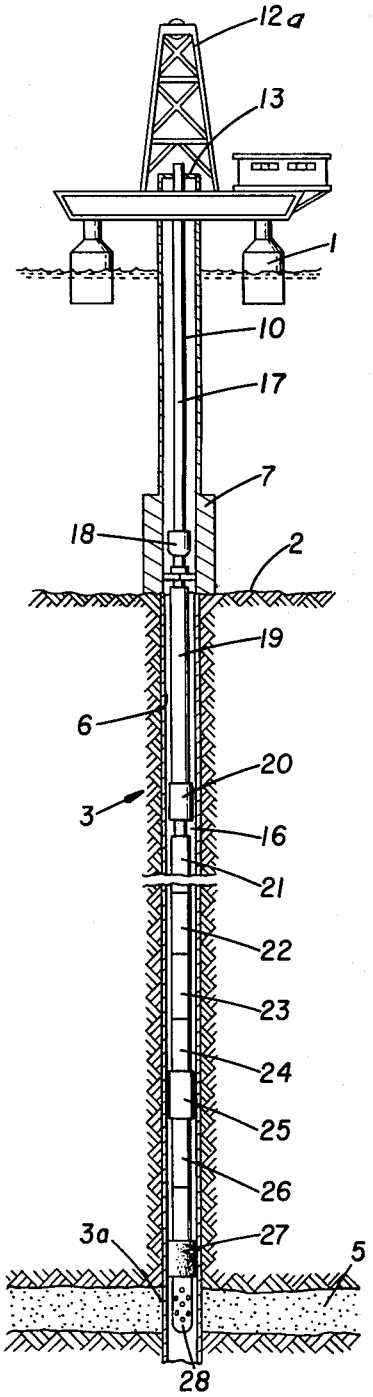
FIG. 1 provides a schematic, vertical, elevational view of an offshore test site, illustrating a testing string disposed in a submerged well and intersecting a submerged formation.

FIG. 1 schematically illustrates a representative offshore test operation.

As shown in FIG. 1, a floating drilling vessel or work station 1 is anchored or otherwise secured in position over a submerged well site 2. Submerged well site 2 comprises a bore hole 3, the interior of which may be lined by a casing string 4 in a conventional fashion.

Wellbore 3, and usually casing 4, intersect a formation 5 whose productivity is to be tested.

Where casing 4 intersects formation 5, at area 3*a*, perforations will usually be provided to ensure fluid communication between the formation 5 and the interior 6 of the wellbore 3.

Figure 2:
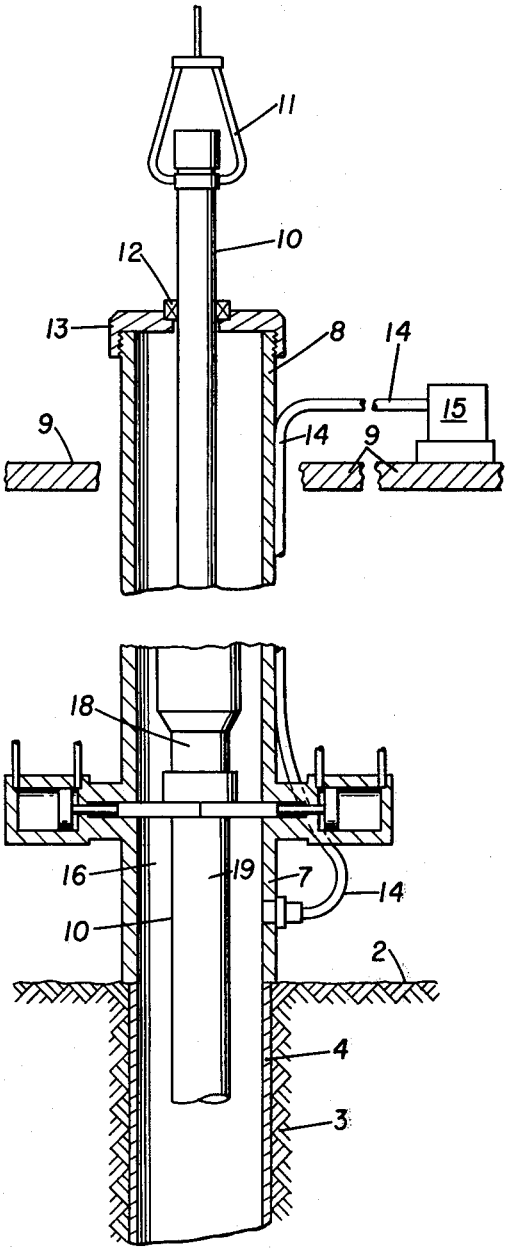
FIG. 2 illustrates an enlarged, vertically sectioned, fragmentary elevational view of a well head portion of the assembly of FIG. 1, located on a floating vessel or work station, and a submerged well head portion having an annulus pressure responsive system.

At the submerged "mud-line" a submerged wellhead installation 7 may be provided. Installation 7 may be provided with a variety of blow-out preventer mechanisms of both the partial closing and "blind" type, the structure and operation of which are generally shown in FIG. 2 of Manes et al., U.S. Pat. No. 3,646,995 filed Dec. 8, 1969, and assigned to the assignee of the present application.

As will be understood, submerged wellhead 7 may also comprise any of several conventional "off the shelf" submerged wellhead units now available.

A marine conductor 8 extends upwardly from wellhead 7 to floating work station 1 and may be laterally supported on deck means 9 of work station 1, generally as schematically shown in FIG. 2. The upper end of conductor 8 may pass slidably through a gimbal connection on deck 9. Such an arrangement, known in the art, provides lateral support for conductor 8 while permitting wave action induced, vertical movement of station 1 relative to the conductor. Conductor slip joints might also be used to accommodate wave action.

A testing string 10 is manipulated at work station 1 by conventional hoisting means 11, conventionally operated from a derrick-like structure 12, as shown in FIG. 1. The usual control head, manifold and swivel arrangements may be provided in the upper end of string 10 to permit conventional circulation of fluid through the testing string and rotary testing string manipulations.

This hoisting means, in conjunction with conventional rotary table slip means would be employed to threadably interconnect sections of the test string 10 and lower the test string 10 through the marine conductor 8 and casing 4 to the general disposition shown in FIG. 1.

As shown in FIG. 2, test string 10 will be disposed in slidable but sealing engagement with a wellhead seal 12. Wellhead seal 12 may comprise a conventional flow head or circulating head mounted on a wellhead closure 13 and defining a transverse annular barrier extending across the upper end of marine conductor 8. As will thus be appreciated, elements 13 and 12 cooperate to provide a seal between the upper end of marine conductor 8 and the exterior of the conduit or test string 10.

A pressuring fluid supply conduit 14, possibly a conventional, safety valve controlled, mud or "kill" line may extend from site 1, downwardly along the exterior of conductor 8, and intersect the wellhead 7 below its blowout preventers, generally as shown in FIG. 2. Such a kill line would usually be attached to the exterior of conductor 8 and would communicate with the upper interior of casing 4. Conduit 14 extends to a conventional "mud pump" 15 on floating site 1. Pump 15 is used to impart pressure to fluid, possibly of a conventional drilling mud nature, contained within and substantially filling the annular void or space 16 surrounding the conduit string 10, and disposed between the string 10 and casing 4 beneath the wellhead 7.

String 10 may include the following components, disposed in consecutively downwardly spaced relation:

| ITEMS | REFERENCE NUMERAL |
|---|---|
| Upper conduit string extending to floating work site 1 (threadedly interconnected conduit sections) | 17 |
| Hydraulically operated, conduit string test tree | 18 |
| Intermediate conduit portion | 19 |
| Torque transmitting pressure and volume balanced slip joint | 20 |
| Intermediate conduit portion imparting packer setting weight to lower portion of string | 21 |
| Circulating valve | 22 |
| Intermediate conduit portion | 23 |
| Upper pressure recorder and housing | 24 |
| Valving and sample entrapping mechanism | 25 |
| Lower pressure recorder and housing | 26 |
| Packer mechanism | 27 |
| Perforate "tailpipe" providing fluid communication between interior of conduit string 10 and formation 5 | 28 |

As shown in FIG. 1, with the testing string 10 installed in position, the packer 27 will have been manipulated to expanded condition so as to provide a seal between the conduit string 10 and the bore hole wall 4. Packer 27 may desirably be of the type shown in U.S. Anderson et al., U.S. Pat. Nos. 3,584,684 and 3,702,634, filed June 2, 1969, assigned to the assignee of the present application.

This packer mechanism is operated in response to rotary and linear manipulations of the conduit string as described in the aforesaid Anderson et al. patents, with sufficient operating weight or movement being transmitted through the string by virtue of the presence of such weight providing elements in the string as the conduit means 21. Such weight is desirable in a testing string of this nature because of the expansible and contractible character of the torque transmitting, but telescoping, slip joint coupling 20. With the weighting elements included in string 10 below coupling 20, downward or upward movement of the conduit string, during its installation, will be effectively transmitted through the string to the operating components of the packer mechanism 27.

After setting of the packer has been initiated, the slip joint 20 will be disposed in a partially contracted condition, the weight of upper elements 17 and 18 of string 10 will be supported by closed blowout preventer rams in wellhead 7, and the drilling vessel 1 will be free to move up and down in relations to the upper end of test string 10. The manner of effecting packer setting as above indicated and the manner in which wellhead rams provide upper test string support by engaging test tree associated abutment means is fully described in the aforesaid Manes et al patents.

During the packer setting, the slip joint 20 effectively isolates wave action induced force from being transmitted through the upper portion of string 10 to the packer 27, as described in the aforesaid Manes et al patents.

The slip joint 20 also permits some tolerance in the extent of downward movement of the upper conduit string portion, after initiation of packer setter, required to "seat" test tree abutment means on the closed rams in wellhead 7.

Since the slip joint 20 permits the upper end of the string 20 to be seated on, i.e., supported by, wellhead 7, it permits the string 10 to be disconnected from fully supported relation with the hoisting mechanism of the vessel 1 and thus isolated from wave actions acting on this vessel. Even if string 10 should remain supported by this hoisting mechanism, the telescoping action of the slip joint would prevent the transmission of wave actions to the portion of string 10 below the slip joint.

With the testing string 10 manipulated so as to seat or expand the packer 27, the expanded packer will provide a seal between the conduit string 10 and the casing or bore hole wall 4, defining the closed lower end of annular void or space 16. With this arrangement, annular space 16 will be effectively isolated from the interior of the conduit string 10 and from the formation 5. In the embodiment described, the closed rams in wellhead 7, upon which test tree abutment means is seated, will provide an annular closure in wellbore 3, defining a closed upper end of annulus 16. Thus, with annulus 16 filled with fluid, such as mud, line 14 will serve to convey pressurized fluid to annulus 16 and increase its pressure, depending on the height of line 14 and the pressure of fluid it conveys.

Even if the support rams in wellhead 7 should not define an annulus seal at wellhead 7, the annular cavity above wellhead 7 between string 10 and casing 4 will be filled with fluid, possibly mud. This body of fluid will define an upper extension or portion of annulus 16, sealed at its upper end by means 12 and 13.

Indeed, in certain circumstances, it may be desirable for the entire weight of the portion of conduit string 10 above slip joint 20 to be supported by hoist mechanism 11, with slip joint 20 being partially contracted to absorb wave action and the rams of wellhead 7 open. This arrangement would provide an annulus 16 extending from packer 27 to conductor closure 13. Pressurizing of such an elongated annulus 16 could be effected by a pressurizing line 14 communicating with the interior of the conductor 8 at the elevation of the vessel 1.

The test tree mechanism 18 incorporated in the conduit string may comprise the safety mechanism described in the aforesaid Manes et al. patent, assigned reference numeral 801 in the Manes et al. patent, and commercially available from Otis Engineering Corporation. Post Office Box 34380, Dallas, Tex. 75234 U.S.A. This mechanism 18 comprises an hydraulically operable valve assembly for selectively closing off or opening the interior passage of the string 10 in the vicinity of the submerged wellhead installation 7. The mechanism 18 is designated by Otis Engineering Corporation as a retrievable "subsea test tree," the structure and function of the apparatus being described in greater detail in the aforesaid Manes et al. patent.

The slip joint mechanism 20 may desirably comprise a pressure and volume balanced slip joint of the type described in Hyde U.S. Pat. No. 3,354,950. The Hyde slip joint comprises an extensible and contractible, telescoping coupling in the conduit string 10, which coupling is pressure and volume balanced, telescoping in nature, and operable to effectively minimize or eliminate the transmission of wave action induced force acting on the upper portion of the conduit string 10 and the floating vessel 1 from being transmitted through the conduit string 10 to the packer 27 and the valving and sample entrapping mechanism 25.

With this basic disposition of components, a valving mechanism included in the device 26 may be operated so as to close the longitudinally extending interior passage of the conduit string 10, open this passage, or close the passage so as to entrap a sample of formation fluid with the body or conduit means portion of the mechanism 25.

As the valving elements of the mechanism 25 are manipulated, the pressure recorders 24 and 26, disposed respectively above and below the mechanism 25, will continuously record the pressure of formation fluid at these sites in the conduit string, in a well recognized fashion.

During the testing operation, or during the removal of the testing string, or during its installation, it may be desirable to effect a circulation of fluid between the interior of the conduit string and the annular space 16. Such circulation of fluid is permitted by the circulating valve 22, which normally is disposed in a closed condition. Valve 22 may comprise a ratchet-type annulus pressure operated sleeve valve such as that disclosed in U.S. patent application Ser. No. 288,187 now U.S. Pat. No. 3,850,250 in the names of John C. Holden and Gary Q. Wray, also assigned to the assignee of this application.

As is often done, from a safety standpoint, the testing string 10 may include a jar mechanism, anticipating the possibility that release of the packer 27 may be impeded for a variety of operational reasons. An effective jarring mechanism which may be utilized for this purpose, and which may be incorporated in the test string above the packer 27, and beneath the recorder 26, comprises an hydraulic jarring mechanism of the type generally featured in Barrington U.S. Pat. No. 3,429,389, or of the type featured in Barrington U.S. Pat. No. 3,399,740.

As a further safety feature, the test string 10 may include a "safety joint" incorporated between the jarring mechanism and the packer 27. A safety joint uniquely suitable for such incorporation is featured in Barrington U.S. Pat. No. 3,368,829. The safety joint would permit the testing string to be disconnected from a stuck packer assembly and removed to the work site.

While the arrangements heretofore described afford the unique advantage of an open or unobstructed interior of string 10 extending downwardly from vessel 1 to mechanism 25, it might be desirable, at times, to utilize additional passage blocking, safety equipment. Thus, as described in the aforesaid Manes et al patent, the lower end of the slip joint 20 might be connected with a test string, passage controlling, reciprocation responsive safety valve, designated item 12 in the Manes et al disclosure.

Under certain conditions, the packer 27 may not be attached to the test string 10. For example, a drillable test packer could be previously set by a "wire line" and the test string later lowered and coupled with the packer via a probe or "stinger" carried by the test string. Such an arrangement is generally described in Evans et al. U.S. Pat. No. 3,493,052.

With the overall installation and test string having been generally described and various alternatives discussed, it now becomes appropriate to consider the general operating characteristics of this invention as reflecting in the structure and operating characteristics of the valving and sample entrapping mechanism 25.

DETAILED POWER SECTION CONSTRUCTION

The sampling mechanism 25 essentially comprises two sections, the power section 30 and the separable sampler section 40.

The power section 30 which occupies the upper part of the mechanism is shown in detail in FIGS. 3*a* through 3*h*. This section, beginning at the top, has an upper adapter 301 having internal threads 302 at the top for connecting in the drill string and external threads 303 on a reduced diameter skirt 304 at the bottom for attachment to the power section 30. Attached to threads 303 is the hydrostatic pressure balanced port valve assembly 305 utilized to prevent the bouyancy of the tool from closing the hydrostatic pressure ports 306 when entering the well fluid. Assembly 305 comprises a cylindrical upper housing 307 attached to a cylindrical lower housing 308, a cylindrical piston mandrel 309 slidably located within outer housings 307 and 308, and coil compression spring 310. Ports 306 pass through the wall of housing 308.

Inner piston mandrel 309 comprises a cylindrical sleeve having an integral annular external piston shoulder 311 and external splines 312 located thereon. Piston shoulder 311 has annular seal grooves 313 on its outer surface for receiving O-ring seals 314 therein. Upper housing 307 has an enlarged inner chamber 315 for sealingly receiving piston shoulder 311 in slidable relationship therein. Housing 307 furthermore has internal splines 316 for engaging with external splines 312 of mandrel 309 to prevent rotation of mandrel 309 within housings 307 and 308. Cylindrical mandrel extension 309a contains one or more ports 320 through the wall.

One or more pressure balancing ports 317 pass through the wall of upper housing 307 and allow annular fluid under hydrostatic pressure to communicate with the upper face 318 of piston shoulder 311.

The bouyancy induced by hydrostatic pressure on the tool is equivalent to the hydrostatic pressure times the cross-sectional area. Thus, the bouyancy trying to push mandrel 309 upward in housings 307 and 308 is equivalent to the hydrostatic pressure times the cross-sectional area of mandrel 309 indicated by reference arrows as $A_3$. The effective counter balancing downward force arises from hydrostatic pressure acting on piston face 318 and is calculated by multiplying hydrostatic pressure times the area of this face. Since this is a circular annular area it is calculated as the area of the outer circle $A_1$, minus the area of the inner circle $A_2$. For ideal balancing condition therefore $(A_1 - A_2) = A_3$. To overcome friction forces and other incidental factors, $(A_1 - A_2)$ should be slightly greater than $A_3$ or, as in this situation, a coil compression spring 310 can be used to further bias against telescoping together of mandrel extension 309*a* and housing 308. In the outermost extended position of mandrel extension 309*a* in housing 308, ports 306 are lined up vertically with ports 320. In case rotation has occurred and lateral misalignment of the two sets of ports occurs, an annular groove 319 is located around the exterior of extension 309*a* to intersect all of ports 320 and provide continuous fluid communication between the two sets of ports regardless of horizontal rotation.

Lower housing 308 has seals 321 therein to seal against mandrel extension 309*a* and prevent fluid communication therebetween. Upper adapter 301 has internal seals 322 to seal against mandrel 309, and mandrel extension 309*a* has external seals 323 above and below ports 320 to prevent fluid communication between mandrel extension 309*a* and lower housing 308 around the port area.

The void areas between seals 314 and seals 321 are initially at atmospheric pressure and therefore allow a pressure differential to form across piston 311 from hydrostatic pressure acting on piston face 318. Atmospheric pressure has access to these areas through ports 324 in mandrel 309. The void spaces between seals 321 and seals 323 are at hydrostatic pressure from fluid entering one or more ports 391 in the wall of lower housing 308. Circular seal 325 is located between the upper and lower housings to prevent fluid leakage therebetween.

Below assembly 305 is located the upper inert gas chamber floating piston assembly 326 having two slidable floating pistons 327 and 328 located therein. These two pistons are annular cylinders each having internal and external seal means 329. The piston chamber is formed by cylindrical external housing member 330 which is fixedly attached to the lower end of mandrel extension 309*a*. Located concentrically within housing 330 and pistons 327 and 328 is a cylindrical uppermost inner barrel 331 which sealing engages mandrel extension 309*a* through seals 322*a* and sealingly engages an orifice member 333 through seals 332*b* to form a fluid tight chamber 334 around pistons 327 and 328.

Annular fluid access to chamber 334 is accomplished through ports 306 and 320. A fluid cushion of oil 335 is maintained between pistons 327 and 328 and held there by seals 329. Below the lower piston 328 is an inert gas such as nitrogen compressed under predetermined pressure.

Upper orifice member 333 is a cylindrical extension of housing 330 having a reduced inner diameter forming an inward extending thicker section 333*a*. The thicker wall area serves to provide material through which pass one or more orifice channels 336 communicating with lower gas chamber 337. Member 333 also has an inner shoulder 333*b* on which is seated inner barrel 331 and an upper intermediate inner barrel 338. Seals 339 prevent fluid communication between the orifice member 333 and housing members 330 and 340.

Upper intermediate barrel 338 is sealingly engaged with upper orifice member 333 and a lower orifice member 343 by seal means 341*a* and 341*b* respectively.

Lower orifice member 343 is similar in construction to upper member 333 and has one or more orifice channels 342 communicating lower gas chamber 337 with the inert gas filler chamber 344.

It should be noted that uniform sections of chambers 334 and 337 have broken out in order to shorten the drawings and facilitate understanding of the invention.

Gas filler chamber 344 is formed by an outer housing connector 345 having a cylindrical configuration, and a lower intermediate inner barrel 346. In the annular space between connector 345 and barrel 346 is a valve piston 347. Connector 345, piston 347 and barrel 346 cooperate to provide an inert gas filler assembly 353 for the apparatus. Connector 345 has a gas filler port 348 and a pump actuating port 349. Piston 347 is an annular sleeve type piston concentrically and slidably located between housing 345 and barrel 346. It has an enlarged diameter 351 at the top containing circular seals 350, and a lesser diameter section 352 comprising the lower approximately two-thirds of the piece.

The enlarged end 351 acts as a differential pressure area so that when actuating fluid or quasi fluid such as oil or grease is pumped under pressure through port 349 a resultant force upward will be applied on the piston.

In the position shown, the filler valve assembly 353 is in a closed position. Lower section 352 of the piston covers gas filler port 348 and circular seals 354*a* and 354*b* above and below the port prevent leakage of the inert gas between the piston and the housing. When it is desirable to open the filler port to either add more inert gas or to drain inert gas, plug 355, which is threadedly secured in actuating port 349, is removed and fluidic pressure is applied through the port to piston shoulder 351. A convenient method of applying this pressure is by means of a common grease gun, such as mechanics use, with an attachment for connecting into port 349. Upon application of sufficient pressure across differential pressure area 351, piston 347 will move upward in response to the hydraulic force on it. This will move seals 354*b* upward past filler port 348 until the lower end of the piston clears the port. The inert gas can then be inserted into the port whereupon it flows to the various chambers in the tool. Piston 347 has a sufficiently large inner diameter to allow the inert gas to flow between the piston and the inner barrel 346.

When filling is completed, pressure on the actuating fluid is released at port 349 and the internal pressure of the inert gas which has been injected into the tool will force piston 347 back downward, closing off and sealing the filler port 348 by locating seals 354*a* and 354*b* above and below the port.

Plug 355 can then be replaced in pumping port 349 to protect that port against sediment and well fluids and a similar plug 356 can be placed in the filler port 348 to likewise protect it and further seal it off against gas leakage. It should be noted that the smallest inner diameter of housing connector 345 at 357 is large enough to allow the inert gas to pass downward between the connector and inner barrel 346.

Located immediately below housing connector 345 is shuttle valve assembly 360. This comprises a sliding cylindrical piston mandrel 358 concentrically located within housing member 359, which is attached to housing connector 345, with piston mandrel 358 encircling inner barrel 346. Pison mandrel 358 is a cylindrical sleeve having an upper skirt 358*a* and a lower skirt 358*c* divided by an annular piston shoulder 358*b*. Mandrel 358 has sufficiently large inner diameter throughout to provide a flow space between it and inner barrel 346.

Located concentrically around upper skirt 358*a* is an upper cylindrical sleeve spacer 361 to limit upward travel of mandrel 358 by abutment with lower end of housing connector 345 and shoulder 358*b* of mandrel 358. Spacer 361 has seals 362*a* and 362*b* on its outer and inner surfaces to seal against housing 359 and mandrel 358 respectively. Lower cylindrical spacer sleeve 363 is located below piston shoulder 358*b*, encircling lower skirt 358*c*, and having seals 363*a* on its exterior and 363*b* on its interior surfaces to seal against housing 359 and mandrel skirt 358*c* respectively. Mandrel shoulder 358*b* has circular seals 358*d* thereon to seal against housing member 359. Lower spacer sleeve 363 limits downward movement of mandrel 358 by abutment with shoulder 358*b* and inner housing extension 364 which is concentrically located inside housing member 359, and indirectly attached thereto by means of connecting member 365. Extension 364 is a cylindrical sleeve type member having an upper skirt portion 364*a* with enlarged inner diameter to accomodate the lower end of mandrel skirt 358*c*, a stepped inner shoulder 364*b* to accommodate the lower end of inner barrel 346, and inner ridge 364*c* to limit downward movement of the inner barrel.

Extension 364 has seals 366*a* to seal against housing 359, seals 366*b* and 366*c* to seal against mandrel skirt 358*c*, and seals 366*d* to seal against inner barrel 346.

Housing 359 has pump-open port 367*a* and a pump-closed port 367*b* through the wall thereof communicating with the inner mandrel 358 and spacer sleeves 361 and 363. When not in use, these two ports are filled with protector plugs 368*a* and 368*b* respectively.

Mandrel 358 has relief port 369*a* and communication port 369*b* through the wall of skirt 358*c*. In the open position, as shown in FIG. 3*e*, port 369*b* aligns vertically with port 370*a* and annular groove 370*b* which passes circumferentially around the inner surface of extension 364 intersecting port 370*a*. This alignment allows communication of inert gas from the upper part of the tool, through the space 371*a* between mandrel 358 and barrel 346 to the lower part of the tool via the annular space 371*b* between housing member 359 and inner housing extension 364.

If it becomes desirable to remove the upper portion of power section 30 from the lower portion, the connecting member 365 may be detached from housing member 359 and extension 364 by unscrewing the threads therebetween. To prevent loss of the inert gas held in the upper portion, mandrel 358 is moved downward to close ports 369*b* and 370*a* off from one another. This is accomplished by removing plug 368*b* from port 367*b* and attaching a fluid pressure means, such as a common grease gun, to the port 367*b* and applying pressure thereto. This pressure will operate on piston shoulder 358*b* to force it downward until abutment of spacer sleeve 363 on extension 364 occurs. Upper spacer 361 moves upward in response to the fluidic pressure. Lower skirt 358*c* moves down across port 370*a* and groove 370*b* thereby blanking them off, and seals 366*b* and 366*c* prevent any leakage along skirt 358*c* through port 370*a*. In the closed position, the mandrel 358 is in a balanced position and will be held closeed by seal friction so that the pressure source can be removed and protector plug 368*b* replaced in port 367*b*. When it becomes desirable to reconnect the inert gas supply from the upper portion of the tool to the lower portion, for instance after the lower portion has been reattached to the upper portion, both plugs 368*a* and 368*b* are removed and a pressure source is connected to opening port 367*a*. When pressure is applied to the port it works against piston 358*b* to move mandrel 358 back to its uppermost position whereupon ports 369*b* and 370*a* are realigned and communication is achieved therethrough. Plug 368*b* is removed to prevent back-pressure buildup above piston 358*b* due to fluid which normally would be trapped there were port 367*b* not opened.

Port 369*a* in skirt 358*b* is provided to allow inert gas to drain from beneath lower spacer 363 and piston shoulder 358*b* when the mandrel is moved downward to close the valve assembly. This prevents a gas trap from forming below the mandrel and allows easier downward movement thereof.

Immediately below housing connecting member 365 is the lower floating piston assembly comprising an external housing member 372 attached to connecting member 365 and being a cylindrical tubular piece. Located concentrically within housing 372 is a floating annular piston sleeve 373 having external seals 373*a* and internal seals 373*b* located thereon. Lowermost inner barrel 374 is an elongated cylindrical tubular mandrel located concentrically within connecting member 365 and piston 373 and sealingly engaged with member 365 by seals 374*a*.

Inert gas which passes through ports 369*b*, 370*a*, and annular space 371*b*, is communicated to lower piston chamber 375*a* through port 376 in connecting member 365 and into annular space 376*a* between member 365 and inner barrel 374. Piston 373 provides a sealing barrier between the inert gas in chamber 375*a* and the oil cushion in chamber 375*b*. Seals 373*a* provide sealing engagement with the interior surface of housing 372 and seals 373*b* provide sealing engagement with inner barrel 374.

Located below chamber 375*b* is an inner annular shoulder 372*a* in housing 372 through which passes an oil filler port 372*b* having a removable plug therein. An annular passage 377*a* communicates from chamber 375*b* to an inner annular recess 377*b* in shoulder 372*a*. An impedance metering rod channel 377*c* communicates from recess 377*b* to metering mandrel 378 having therein an axial orifice 378*a* opening up into spring chamber 379. Metering rod 380 is located within channel 377*c* to provide hydraulic impedance to oil flow therethrough.

Diametrically opposite channel 377*c* in shoulder 372*a* is relief bypass channel 381 shown in dashed lines, having a ball and spring type check valve assembly 382 in the spring chamber end thereof and communicating with annular recess 377*b*. Furthermore, annular shoulder 372*a* contains an inner annular recessed portion 372*c* about inner barrel 374, which is in communication with a second filler plug 381*a*.

Seals 374*b* between shoulder 372*a* and barrel 374 prevent fluid leakage between these two elements. Spring chamber 379 is formed by metering mandrel 378 in conjunction with a lower external cylindrical housing 383 and cylindrical bottom adapter 384 attached to housing 383. The inner wall of spring chamber 379 comprises inner barrel 374 to which is attached power piston 385 and cylindrical tubular sampler pull coupler 386. Barrel 374, power piston 385, and coupler 386 move as a single unit in sliding relationship inside external housing members 365, 372, 383, and cylindrical adapter 384. Coil spring 387 is disposed around barrel 374 and between metering mandrel 378 and power piston 385, and works in compression to bias the power piston towards its lowermost position as shown in FIG. 3*h*. Power piston 385 is a cylindrical sleeve having a raised annular piston shoulder 385*b*, seals 385*a* and lower skirt 385*c*.

Power piston seals 385*a* on piston shoulder 385*b* provide sealing engagement with inner wall of housing 383, and seals 384*a* provide sealing engagement between pull coupler 386 and adapter 384.

Pull coupler 386 and adapter 384 have threads 388 and 389 thereon to allow attachment of the separable sampler shown in FIGS. 4*a* through 4*d*.

Housing 383 has one or more annulus pressure actuating ports 390 through the wall thereof to communicate fluid pressure from the annulus area to the power piston shoulder 385*b* which acts as a differential pressure area between the annulus pressure and the internal inert gas pressure.

OPERATION OF THE POWER SECTION

Figure 3A:
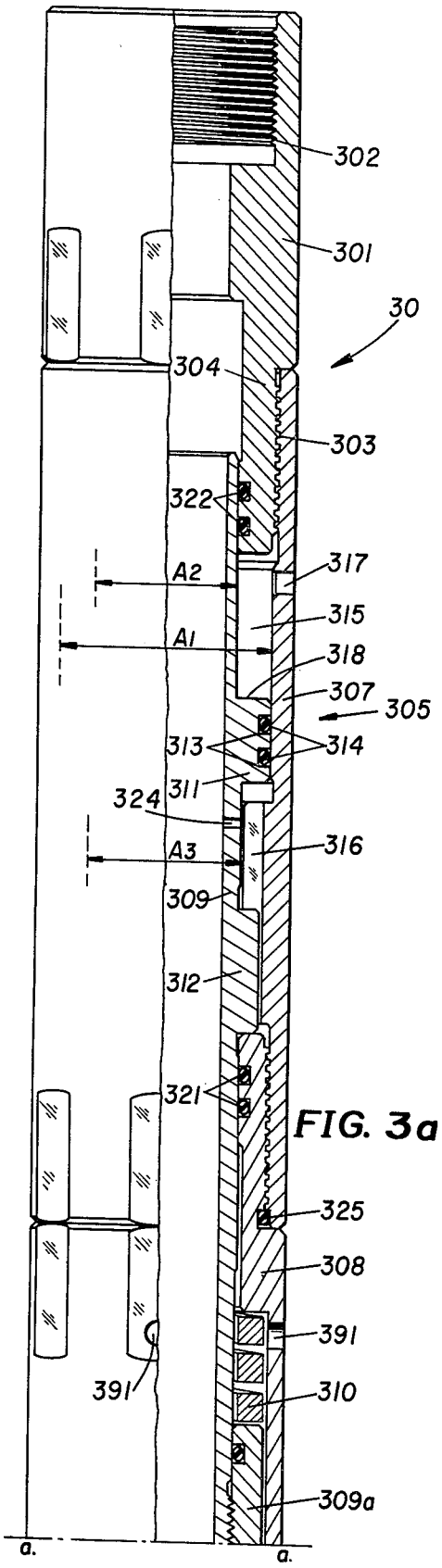
FIGS. 3*a* through 3*h* when joined along common lines *a—a* through *h—h*, provide an enlarged, vertically sectioned, "right-side only" view of the power section of the APR tools.
Figure 3B:
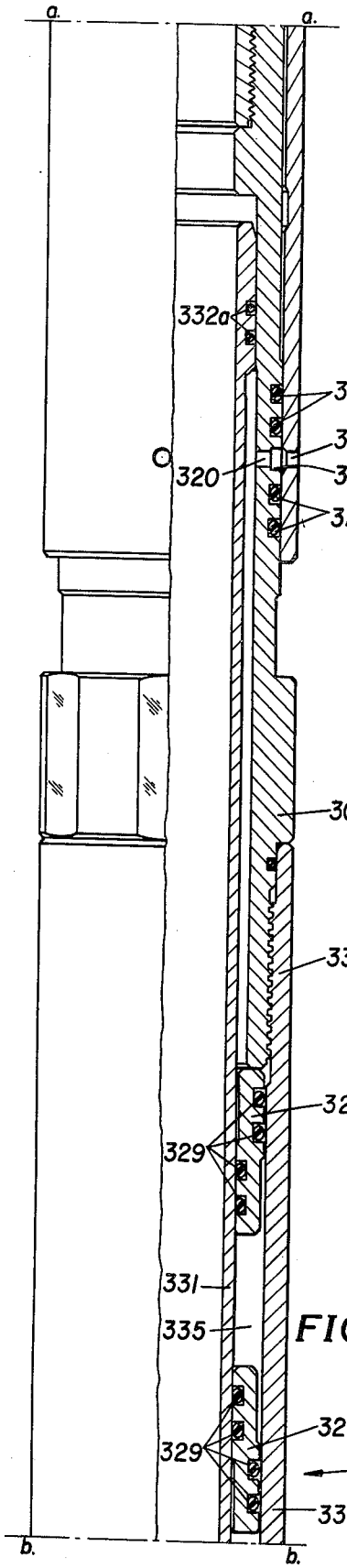
Figure 3C:
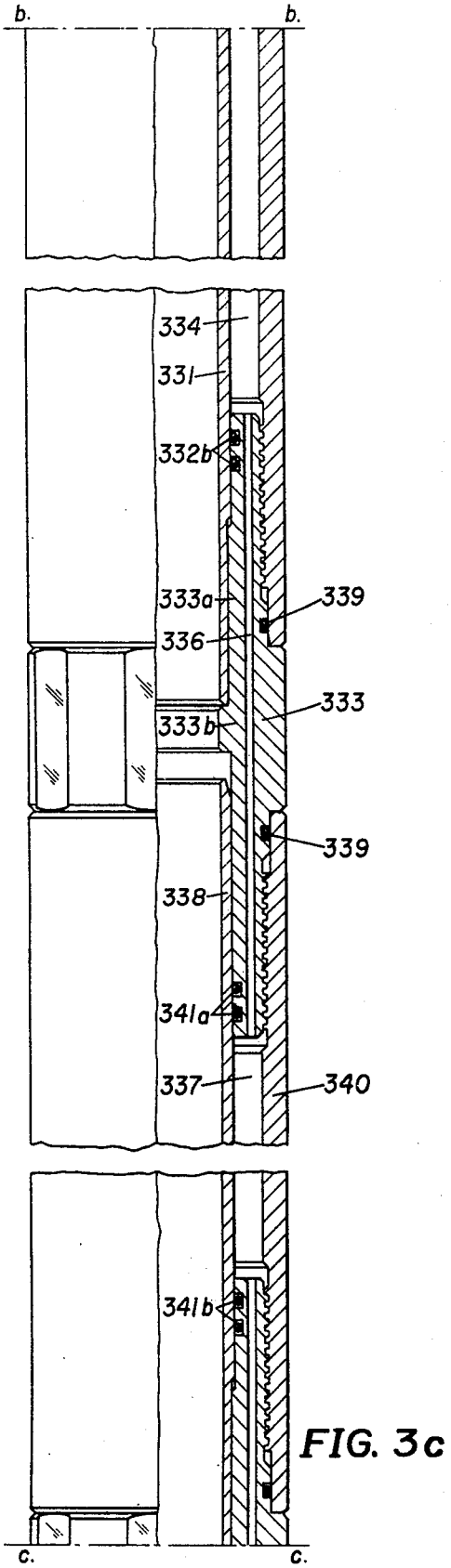
Figure 3D:
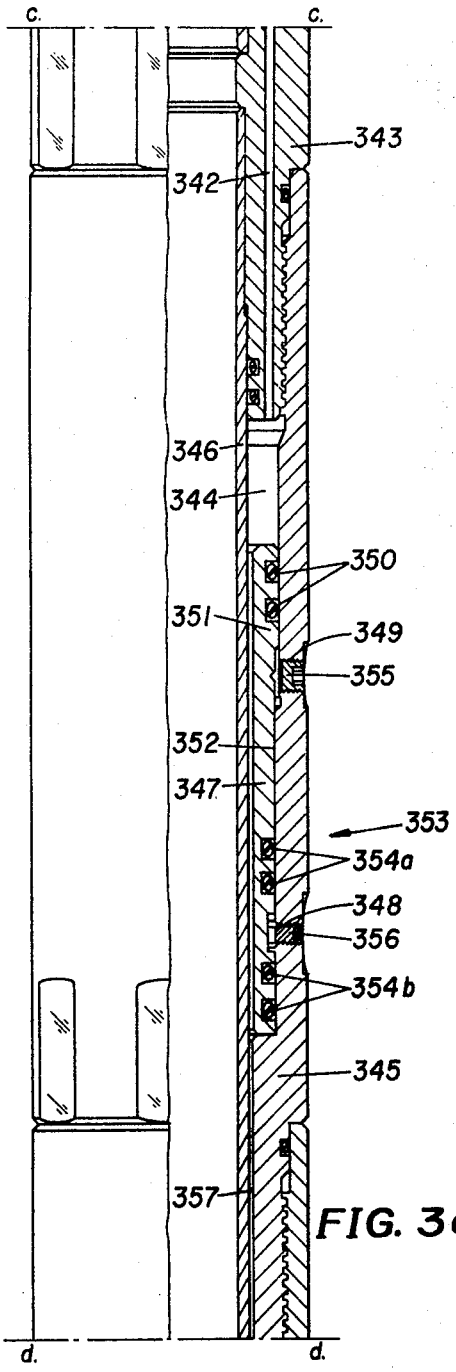
Figure 3E:
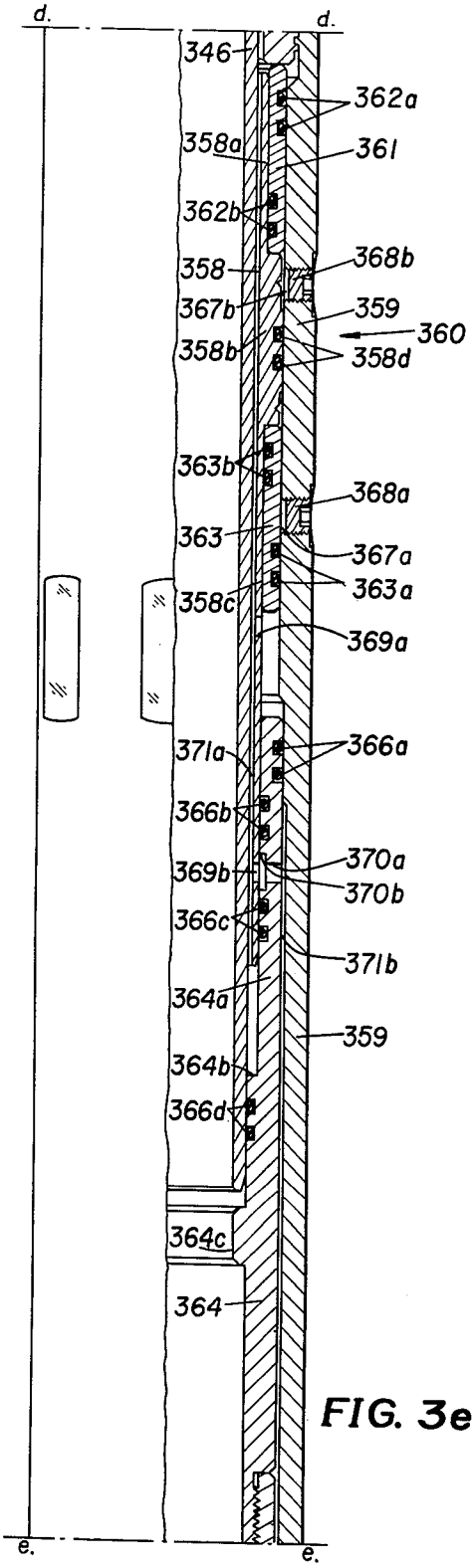
Figure 3F:
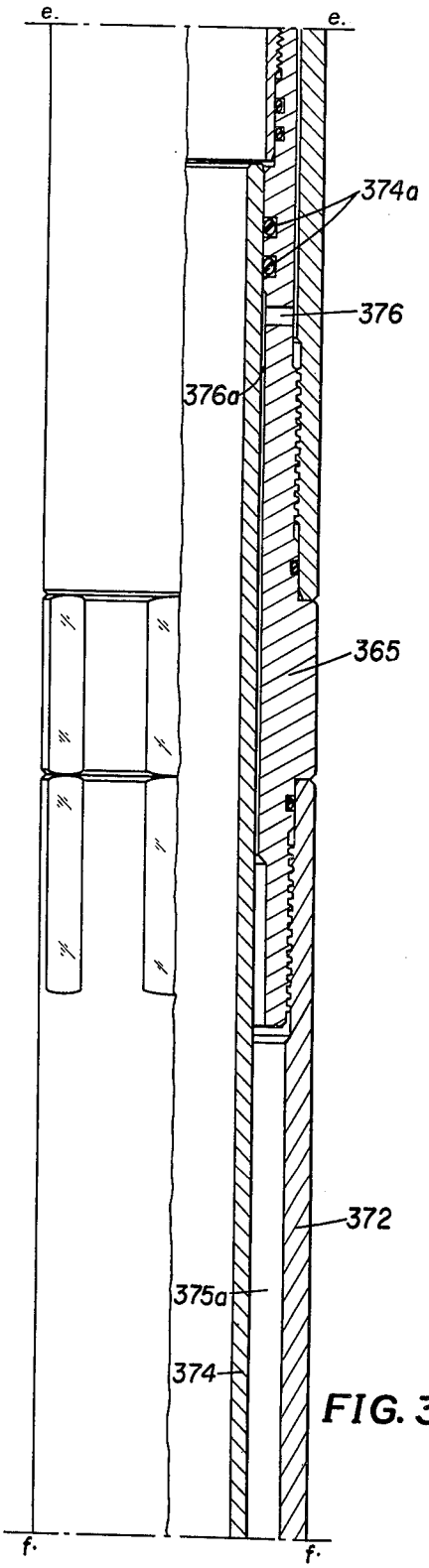
Figure 3G:
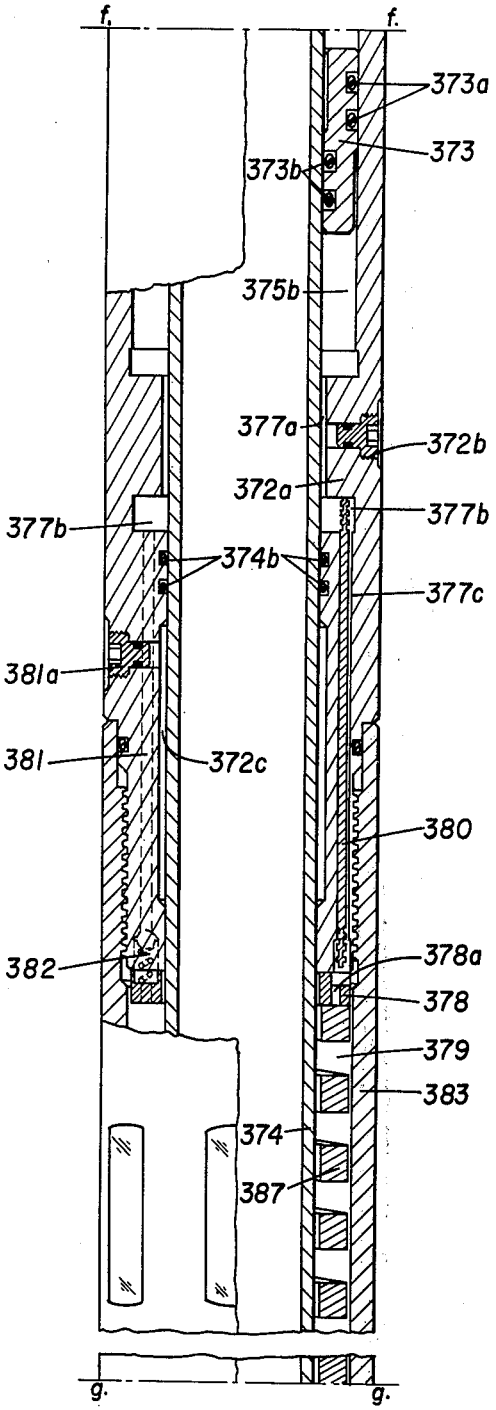
Figure 3H:
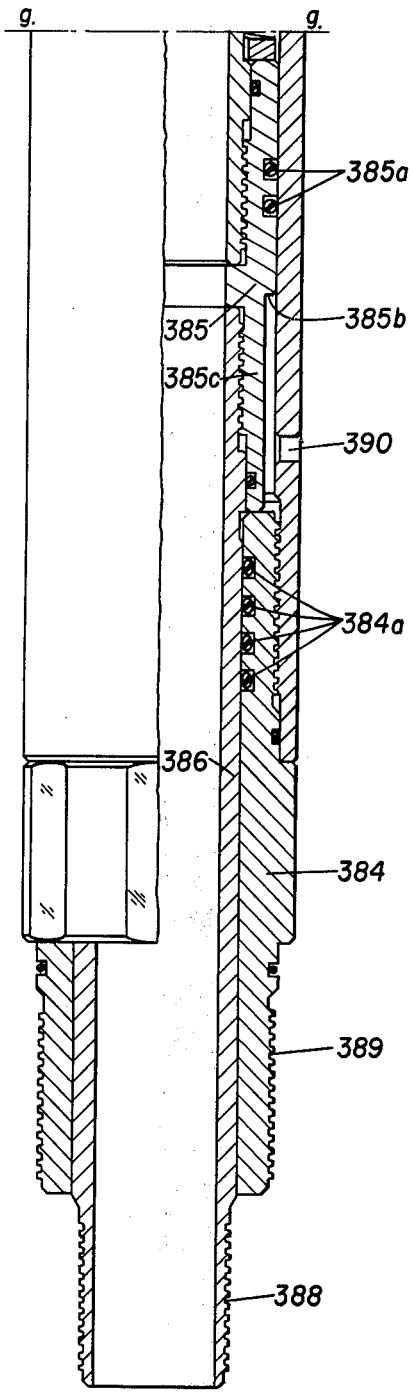

The power section illustrated in FIGS. 3*a* through 3*g* is charged with a relatively low pressure of inert gas in chamber 334 and is then placed in the testing string by threading the upper end in FIG. 3*a* into the conduit or next upper tool in the string. The sampler section 40 is attached to the power section at the lower end and the remainder of the test string, including a packer mechanism, is attached to the lower end of the sampler section.

While the string is being lowered into the hole, the weight of the string below the power section applies tension to the power section which tension telescopes the port valve assembly 305 into its most extended position as shown in FIGS. 3*a* and 3*b*.

As the string is lowered, any bouyancy arising from the fluid in the well which naturally tends to push the string back upward, is counterbalanced by allowing hydrostatic fluid pressure to react through ports 317 and down against differential pressure area 318.

When the string is in the correct position in the well, the packer is expanded against the borehole by known conventional methods thereby anchoring the lower end of the string against further movement. Then the string is allowed to move further down by the weight of the upper string, thereby telescoping assembly 305 inward which is a result of housing 307 and 308 moving downward over internal mandrel 309.

During the descent of the power in the borehole, because of the tension on the assembly 305, annulus pressure access ports 306 and 320 remain in vertical alignment with peripheral groove 319 guaranteeing fluid communication therebetween. Annulus pressure increases proportionately to the depth of the tool in the well fluid. The increasing annulus pressure arising with the descent of the tool acts through ports 306 and 320 and down between barrel 331 and mandrel extension 309*a* to upper piston 327. An hydrulic fluid is located between pistons 327 and 328 to provide a better seal between the annulus fluid above piston 327 and the inert gas below piston 328. The annulus pressure acting on piston 327 is transferred via the hydraulic fluid to piston 328 which moves downward with piston 327 to compress the inert gas in chamber 334. This process occurs until the tool reaches bottomhole whereupon the inert gas will then be at hydrostatic pressure of the annulus fluid.

When the string reaches location, the above mentioned packer is set and weight is set down on the packer thereby moving housing 308 downward over mandrel extension 309*a*, moving ports 306 out of alignment with ports 320 and sealing off the inert gas chamber from further hydrostatic pressure of the annulus fluid.

At this point the power section may be remotely actuated by applying fluidic pressure to the annulus fluid, which increased pressure acts through ports 390 and upward against power piston shoulder 385*b* thereby moving piston 385 upward while compressing coil spring 387 and inert gas in chamber 375*a* through abutment with hydraulic fluid between piston 385 and floating piston 373. Upon release of the applied pressure on the annulus fluid, the biasing action of spring 387 and inert gas above piston 373 acts on piston 385 moving it back downward into its at-rest position.

Movement upward of piston 385 is transferred to the sampler section 40 by way of pull coupler 386 which is fixedly secured to piston 385 and to the pull coupler connector section 438 of the sampler section.

When it is desirable to remove the tool from the hole, applied pressure on the annulus fluid is released, the packer is released, and the string is pulled upward. This once again extends port valve assembly 305, aligning ports 306 with ports 320, and allows the supplemental hydrostatic pressure acting on pistons 327 and 328 to drain off as the tool comes out of the hole and hydrostatic pressure of the annulus fluid decreases in proportion to the decreasing tool depth.

THE SAMPLER SECTION

Figure 4A:
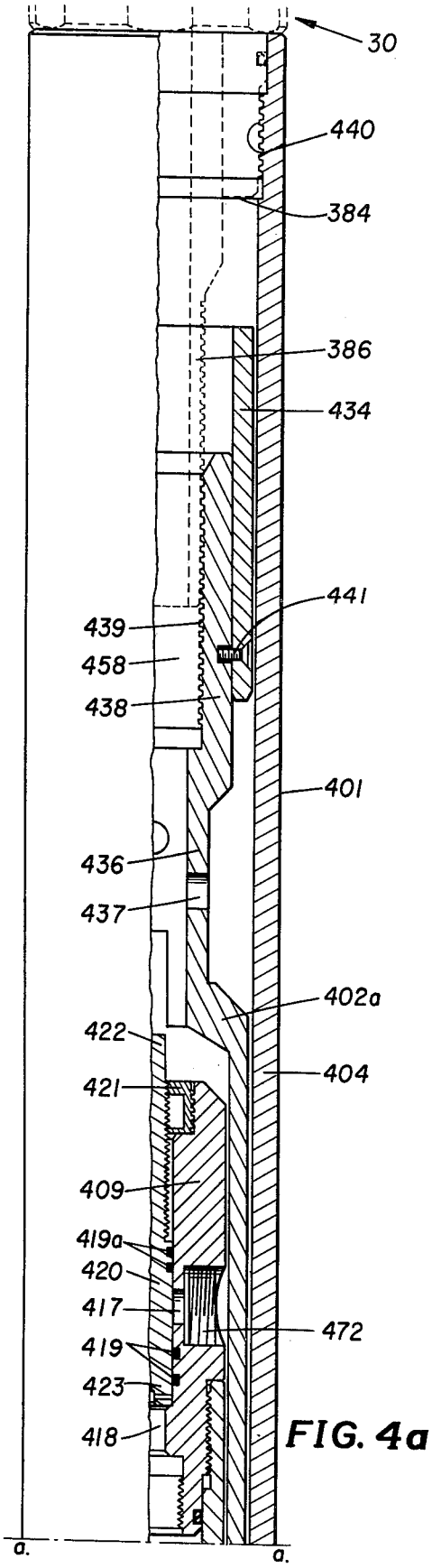
FIGS. 4*a* through 4*d* when joined along common lines *a—a* through *d—d*, provide an enlarged, vertically sectioned, right-side only view of the separable sampler of the APR tool.
Figure 4B:
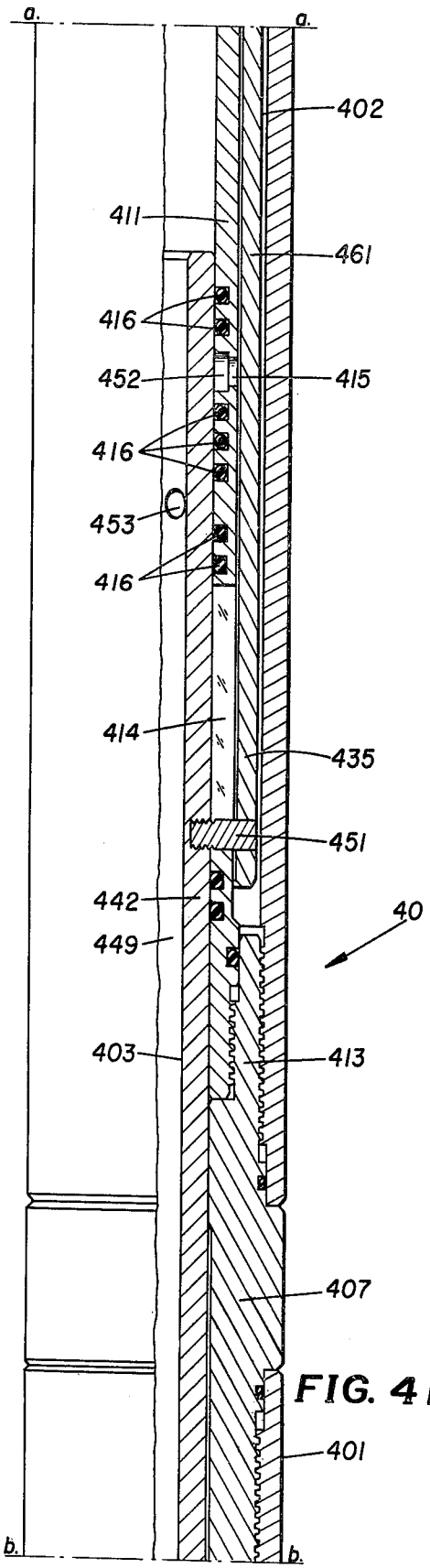
Figure 4C:
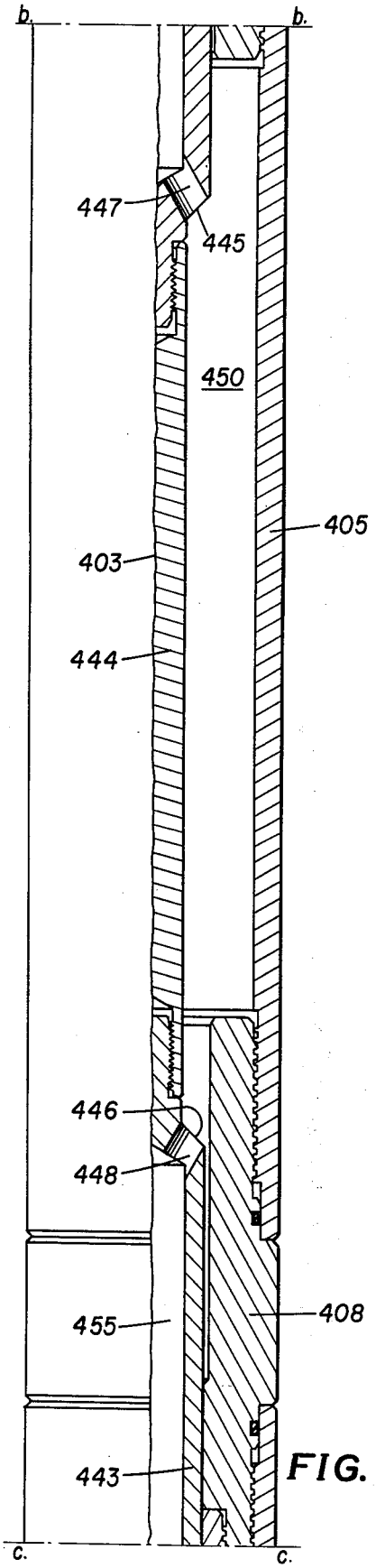
Figure 4D:
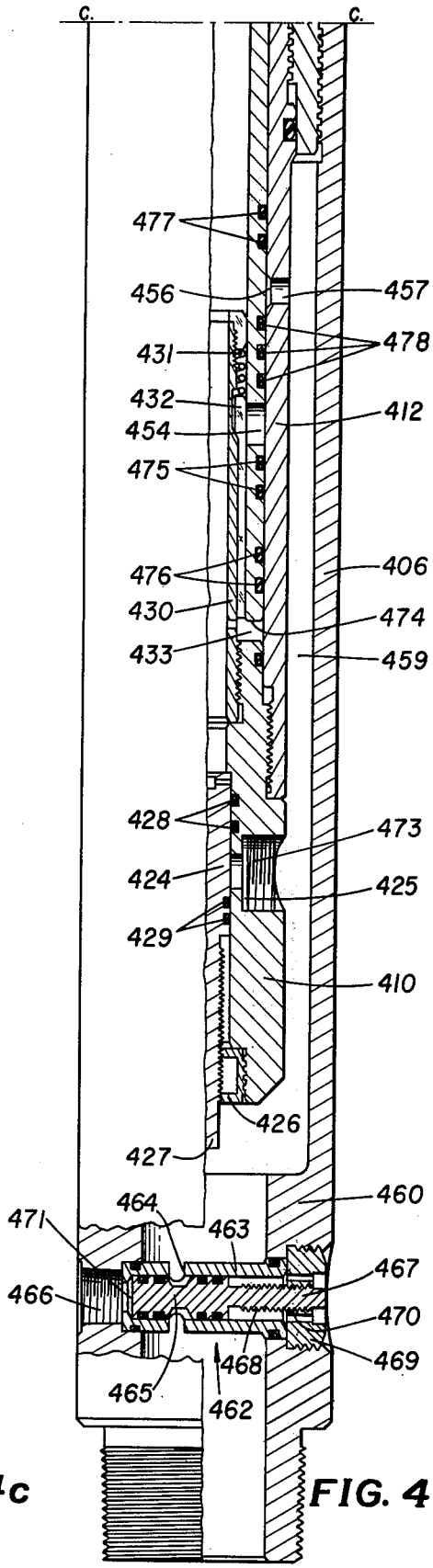

The separable sample 40 is shown in detail in FIGS. 4*a* through 4*d*. FIG. 4*a* shows in phantom the lower end of the power section 30 and illustrates how the power section 30 and sampler section 40 are joined.

Sampler section 40 consists basically of a stationary housing assembly 401, a pull mandrel assembly 402 and a valve mandrel assembly 403.

Housing assembly 401 consists of a cylindrical tubular upper external housing 404, intermediate housing 405, and lower housing 406, as well as threaded assembly connector collars 407 and 408, upper and lower drain valve heads 409 and 410, and upper and lower flow port sleeves 411 and 412.

The three external housing 404, 405 and 406 are joined together by means of connector collars 407 and 408 to form a substantially cylindrical elongated tubular member.

Upper connector collar 407 has an inner threaded section 413 which receives upper flow port sleeve 411 in fixedly attached relationship therewith. Sleeve 411 is a tubular, cylindrical, slotted sleeve having a longitudinally extending slot 414 through the wall thereof. Also passing through the wall of sleeves 411 and 412 are two sets of one or more flow ports 415 and 457. Circular seals 416 are located in annular recesses in the internal bore wall of sleeve 411. Fixedly attached to the upper end of sleeve 411 is the upper drain valve head 409 which is a relatively thick-walled tubular member having a large exit port 417 passing through the wall thereof. Head 409 has a restricted axial bore 418 passing longitudinally therethrough. The inner wall of bore 418 has annular seal means 419 located in recesses therein.

A solid cylindrical plug means 420 is sealingly engaged within bore 418 of head 409 and threadedly held therein by annular adapter 421.

Upper end 422 of plug 420 is polygonal-shaped to allow a wrench to be applied thereto in order to rotate plug 420 in head 409. Counterclockwise rotation of plug 420 results in axial movement outward of plug 420 in head 409 and sufficient movement outward will result in the lower end 423 of plug 420 clearing exit port 417 so that fluid within the central bore of sampler section 40 may flow outward through port 417. Seals 419 and 419*a* prevent fluid flow between plug 420 and the inner bore wall of head 409 until plug end 423 moves outward port 417.

The construction and orientation of the lower flow port sleeve 412, lower drain valve head 410, and lower head plug 424 are very similar to that of the upper port sleeve 411, upper head 409, and plug 420 as described above, but in an inverted orientation thereto. The operation, function, and purpose of these lower elements are substantially identical to the aforementioned upper ones. Plug 424 serves as a valve member to cover or uncover exit port 425 in lower head 410 by threaded conjunction with annular adapter 426. Plug 424 has a polygonal head 427 and engages seal means 428 above port 425 in the inner bore of head 410. Seals 429 in plug 424 provide sealing engagement with plug 424 below port 425.

In addition, lower head 410 has fixedly attached at the upper end thereof, a tubular lock-closed sleeve 430 with biasing spring 431 located thereon in conjunction with one or more prop arms 432 swingably attached to sleeve 430 at their lower ends. The function and purpose of sleeve 430, biasing 431, and prop arms 432 will be more particularly described later in conjunction with the operation of the sampler section. Sleeve 430, in conjunction with sleeve 412, serves to form an extended annular slip space 433 therebetween.

The pull mandrel assembly 402 comprises an elongated pull mandrel yoke 402*a* having a cylindrical limit-stop sleeve 434 frangibly attached exteriorly thereto by shear pins 441 in telescopic arrangement. Pull mandrel assembly 402 is slidably arranged concentrically within upper external housing 404 and has a lower expanded elongated yoke section 435 passing slidably and concentrically in relatively close relationship between housing 404, head 409 and sleeve 411. Located above yoke section 435 is necked tubular section 436 having a reduced diameter and one or more ports 437 through the wall thereof. Integrally attached to section 436 is the pull coupler connector section 438 having an intermediate diameter and having internal threads 439 therein for attaching to the power section pull coupler 386. Likewise, upper housing 404 has internal threads 440 at its upper end for engaging adapter 384 of the power section 30.

Mandrel yoke 402*a* and limit-stop sleeve 434 are located so that yoke 402*a* has approximately two inches of travel from its lowermost position as illustrated, to its uppermost position whereupon limit-stop sleeve 434 is abuttingly engaged with the lowermost end of adapter 384 thereby, under normal operating conditions, preventing any further upward movement of the mandrel assembly 402 within housing 404.

Valve mandrel 403 consists of an elongated, tubular, cylindrical piece having enlarged upper section 442 and lower section 443 joined together by attachment to a reduced-diameter, solid central section 444.

Near the lower end of section 442 and near the upper end of section 443 are short, tapered frusto-conical wall sections 445 and 446 respectively, having a plurality of flow ports therethrough numbered 447 and 448 respectively.

Upper section 442 is slidably located within collar 407 and sleeve 411 and sealingly engaged therewith and has an inner bore 449 communicating through ports 447 to an annular chamber area 450 formed by the concentric arrangement of the external housing 405 and the reduced central section 444. Chamber 450 also communicates with the inner bore 455 of lower section 443 through ports 448 in conical wall 446.

One or more linkage pins 451 are securedly imbedded in the wall of upper section 442 and pass radially through one or more slots 414 in the upper flow port sleeve 411. Pins 451 extend far enough through slots 414 to be securedly engaged with the arms of pull mandrel yoke 402*a*. Slots 414 and pins 451 are designed to allow pins 451 to slide freely through slots 414 in a longitudinal, axial direction yet prevent any significant angular rotation therein.

Furthermore, it should be noted that upper and lower sections 442 and 443 of valve mandrel 403 have a plurality of ports 453 and 454 respectively through the wall thereof, circumferentially spaced thereon, and arranged to communicate with annular grooves 452 and 456 cut in the inner bore wall of flow port sleeves 411 and 412. Grooves 452 and 456 are located so that they intersect flow ports 415 and 457 to allow fluid communication therethrough when ports 453 and 454 are axially aligned therewith, even though ports 453 may be peripherally non-aligned with ports 415, and ports 454 may be peripherally non-aligned with ports 457.

In the lowermost position of valve mandrel 403, with respect to housing assembly 401, ports 415 and 457 are sealed off from bores 409 and 455 and chamber 450 by the blocking position of the upper and lower sections of the valve mandrel 403.

When mandrel 403 moves to its uppermost position, ports 415 and 457 are aligned axially with ports 453 and 454 respectively. Fluid flow is then possible throughout the entire length of the apparatus by flowing through inner bore 458 of the pull mandrel assembly, through ports 437, between the arms of yoke 402*a*, through ports 415 and 453, through bore 449, ports 447, bore 450, ports 448, bore 455, and through ports 454 and 457 into bore 459 which communicates with the lower part of the string through well conduit attached to the lower end 460 of housing 406.

Figure 5:
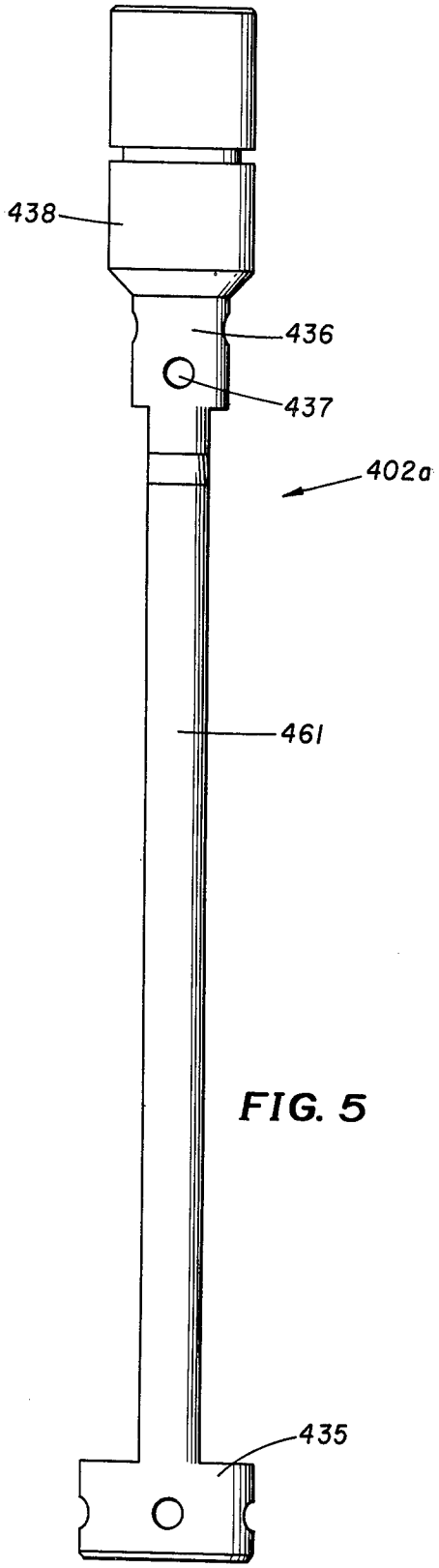
FIG. 5 is an elevational side view of the pull mandrel yoke.

FIG. 5 illustrates the construction of pull mandrel yoke 402*a* having one or more arms 461 which pass downward outside of sleeve 411 and are pinned to valve mandrel 403 by pins 451. The preferred embodiment herein utilizes two yoke arms diametrically opposed one from the other to thereby provide sufficient pull strength which is balanced across the diameter of the yoke, and also allow the greatest open area to fluid flow between the yoke arms.

Additionally, a spool type relief valve 462 is located through the lower end 460 of lower housing 406. This valve is designed to allow the operator to drain off high pressure well fluids and/or gases which may become trapped in bore 459 between the closed sampler chambers 449, 450, and 455 and the closed valve below the sampling mechanism 25.

Valve 462 consists of a cylindrical outer housing 463 having two or more ports 464 through the wall thereof, with a threaded spool assembly 465 sealingly engaged therein. In the illustrated position the valve is closed but does allow flow around it along bore 459. After the sampler has been filled and closed and it is desired to drain off the hazardous fluids trapped in bore 459, a conduit (not shown) can be threadedly attached in threaded opening 466 of housing end 460 and the polygonal upper end 467 of spool assembly 465 can be turned counterclockwise with a common wrench. This rotates the spool outward by action of threads 468 on the spool with threads 470 on annular adapter 469 located securely in housing end 460. Continued rotation of spool assembly 465 will move the end 471 of the spool past ports 464 and allow the trapped fluid to flow therethrough and out threaded opening 466 into the drain conduit (not shown).

Operation of the separable sampler section 40 occurs in the following manner. A sufficient annulus pressure increase acting on the power section 30 of the sampler mechanism 25 results in an upward movement of pull coupler 386. In the orientation of the sampler section 40 as illustrated, the sample chamber is initially closed to fluid flow therethrough and no flow can occur through the conduit string.

Upward movement of the pull coupler 386 pulls the pull mandrel assembly 402 upward with it until limit-stop sleeve 434 abuts the bottom end of adapter 384. In this position the sampler is fully opened and flow can occur therethrough and throughout the conduit string. The sampler can be held open by continuous application of the actuating pressure on the annulus fluid. In the open position, pull mandrel assembly 402, working through pins 451, have pulled the valve mandrel assembly 403 upward until ports 415 are aligned with ports 453 which simultaneously aligns ports 457 with ports 454, which alignment provides an open flow path through the sampler as previously described.

When it is desired to cease flow tests and begin pressure buildup tests or trap a sample, actuating pressure is released from the annular fluid which allows the inert gas and spring biasing means in the power section to move the pull coupler 386 back to its initial position thereby moving the valve mandrel assembly 403 back downward, closing off flow ports 415 and 457.

A sample of the well-fluid which was flowing through the open sampler will automatically be trapped in bores 449 and 455 and in annular chamber 450.

After the desired tests have been completed and the sample has been trapped, the test string is removed from the hole and the separable sampler section 40 may be removed from the power section and replaced by an empty one if desired. Before the sampler is removed from the string, though, it is often desirable to remove trapped formation fluids from the void area below the sample chamber which can be accomplished by the use of a conduit attached to threaded opening 466 and manipulation of spool valve 462 as previously described.

After the sampler section 40 is removed from the string it can be shipped to the lab for testing. At the lab, the upper and lower external housings 404 and 406 can be unscrewed from the apparatus and set aside to expose the drain ports 417 and 425. Only one such drain port need be exposed although both can be if so desired. The sample is removed from the sample chamber by attaching a drain conduit (not shown) into the enlarged threaded portion 472 or 473 of drain ports 417 or 425 respectively.

Then threaded plug 420 or plug 424 is screwed out of the end having the drain conduit connected therein until the end of the plug clears the drain port 417 or 425, which-ever the case may be, and the trapped fluid is allowed to exit from the sample chamber.

In addition to providing structural integrity of the sampler section as well as serving to connect the sampler to the power section and the conduit string, upper and lower housings 404 and 406 also serve as protective shields over the sample drain port assemblies during transportation of the sampler from the field to the lab.

As previously noted, the sampler incorporates a further safety feature designed to move the sampler section into a lock-closed position should the well suddenly become overpressured and threaten to blow out through the annulus.

The sudden overpressuring of the annulus fluid will act upon the power section to provide an increasingly greater upward pulling force on the pull mandrel assembly 402 until finally, at a predetermined maximum annulus pressure, shear pins 441 in limit stop sleeve 434 will be sheared thereby allowing the pull mandrel yoke 402*a* to pull the valve mandrel 403 an additional distance upward thereby pulling the bottom end 474 of the mandrel clear of the hinged prop arms 432. At this instant the biasing springs 431 force arms 432 radially outward behind end 474 of the valve mandrel thereby preventing any reverse movement of the mandrel back downward.

This additional increment of upward movement of valve mandrel 403 upon shearing of pins 441 results in moving of ports 453 and 454 out of alignment with ports 415 and 457 thereby closing off any further flow through the sampler. Prop arms 432 serve to keep the valve mandrel in this upward lock-closed position. Seals 475 and 476 located in annular recesses in the outer surface of valve mandrel lower section 443 are located so that in the lock-closed position they straddle the flow port 457 and prevent fluid leakage thereby. Seals 477 and 478 located on lower section 443 above ports 454 serve to prevent fluid leakage thereby when the sampler is in its initially closed and open-flowing orientations.

SUMMARY AND ADVANTAGES OF THE APPARATUS

The sampler mechanism disclosed herein is particularly advantageous for use in wells wherein it is highly desirable to operate tools in the string without resorting to any physical manipulation of the drillpipe such as reciprocation or rotation.

This mechanism provides an annulus pressure operated sampler which is very versatile in that it can be utilized in deep hot holes where the exact pressure and downhole temperature are not known. By the use of this tool these conditions need be determined only approximately.

Furthermore, the sampler mechanism does not require a high pressure inert gas charge in the spring biasing chamber to overcome the high hydrostatic pressure at bottomhole but instead can be charged at relative low pressures at the surface and then utilizes the hydrostatic pressure as it goes in the hole to supplement the inert gas chamber pressure and serve as a biasing-closed means.

In addition, this mechanism employs a safety sampler that is separable from the power section and which can be opened and closed an indefinite number of times by actuation of the power section. The sampler can be removed from the string and sent to the lab with the sample intact and another dry sampler inserted in its place and the test string returned to the hole or taken to another job right away.

Use of this mechanism obviates the need for a power section for each sampler and allows a testing crew to operate almost indefinitely with only one power section and as many sampler sections as needed.

Also the sampler section of this mechanism provides an easily accessible yet protectively shielded drain port mechanism. It also features a lock-closed safety feature that closes and locks the sampler flow ports when an undesirable high pressure condition arises in the annulus.

The sampler section provides a means of draining off formation fluids trapped between the sampler and tools below it in the string. This provides a clean spill-free access and method to drain these usually flammable and always dirty contaminants.

Although a specific preferred embodiment of the present invention has been described in the detailed description above, the description is not intended to limit the invention to the particular forms or embodiments disclosed herein, since they are to be recognized as illustrative rather than restrictive and it will be obvious to those skilled in the art that the invention is not so limited. For example, it would be possible to utilize a varying number of floating pistons in the power section 30, or different spring biasing means than those disclosed as coil springs. Where the porting is disclosed as allowing the supplementary hydrostatic pressure to enter near the top of the power section and actuating annulus pressure to enter near the lower end of the power section, it is obvious that one could reverse the orientation of various tool parts and obtain a reversal of the porting arrangement disclosed herein. The invention is declared to cover all changes and modifications of the specific example of the invention herein disclosed for purposes of illustration, which do not constitute departures from the spirit and scope of the invention.

What is claimed is:

1. An apparatus for use in a test string in an oil well bore for converting applications of fluid pressure in the well annulus between the test string and the well bore into axial movement within said test string, comprising:

a cylindrical tubular external housing assembly having a cylindrical bore therethrough;

a tubular inner barrel assembly having an open bore therethrough and spaced within said housing assembly forming an annular chamber between said inner barrel and said housing assembly for containing a pressurized inert gas;

annulus pressure responsive piston means slidably located within said housing and exposed on one side to fluid pressure in said well annulus and on the second side to the pressure in said annular chamber;

supplementing means between said inner barrel and said housing assembly for supplementing the pressure in said annular chamber with hydrostatic pressure in the well annulus as the apparatus is lowered into the well bore;

valve means having an open position and a closed position for selectively isolating said supplementing means such that hydrostatic pressure in the well annulus while said valve means is in the open position will actuate said supplementing means, and increases in the well annulus pressure subsequent to the closing of said valve means will move said annulus pressure responsive piston means; and an annular inert gas filler valve in the wall of said housing assembly having a filler port communicating with said chamber and an activation port in the wall thereof, and including a sleeve having a piston area communicating with said activation port such that said sleeve is moved from a first position closing said filler port to a second position opening said filler port by selective application of hydraulic pressure through said activation port, and a second piston area communicating with said annular chamber for moving said sleeve from said second position to said first position responsive to pressure within said annular chamber when said hydraulic pressure is removed thereby facilitating communication of pressurized inert gas with said annular chamber.

2. The apparatus of claim 1 wherein said supplementing means is a floating annular piston assembly in one end of said annular chamber exposed on one side to the pressure of said inert gas in said chamber, and exposed on the second side to well annulus pressure when said valve means is in the open position; said floating annular piston assembly comprising spaced apart, axially aligned sleeve pistons and oil located in the space between said sleeve pistons.

3. The apparatus of claim 2 further comprising a shuttle valve between said annular chamber and said annulus pressure responsive piston means having an open position and a closed position for isolating the pressure of said pressurized inert gas from said annulus pressure responsive piston means, wherein said inert gas pressure does not communicate with said annulus pressure responsive piston means when said shuttle valve is in the closed position and said inert gas pressure does communicate with said annulus pressure responsive piston means when said shuttle valve is in the open position.

4. The apparatus of claim 3 with said housing assembly having a second and a third annular chamber and a communicating flow channel therebetween, said second annular chamber communicating with said inert gas filled annular chamber through said shuttle valve, and wherein said annulus pressure responsive piston means is located in said third annular chamber for axial movement in response to changes in pressure in said well annulus; said apparatus further comprising:

a floating annular piston in said second annular chamber and exposed on one side to the pressure of said inert gas;

hydraulic oil in said third chamber, said communicating flow channel, and in that portion of said second annular chamber on the second side of said floating annular piston, said hydraulic oil being displaceable between said second annular chamber and said third annular chamber as said annulus pressure responsive piston means moves in said third annular chamber; hydraulic impedance means and check valve means in said communicating flow channel for impeding the displacement of hydraulic oil in one direction and allowing free displacement of hydraulic oil in the other direction as said annulus pressure responsive piston means moves in said third chamber.

5. The apparatus of claim 4 further comprising a mechanical spring in said third annular chamber acting in conjunction with said pressurized inert gas.

6. An apparatus for use in a test string in an oil wellbore for converting applications of fluid pressure in the well annulus between the test string and the wellbore into axial movement with said test string, comprising:

a cylindrical body having an exterior wall, an inner bore for providing a flow channel therethrough, a first annular chamber in the wall thereof for containing a pressurized gas, a second annular chamber in said wall below said first annular chamber, and a flow passage communicating said first annular chamber with said second annular chamber;

an upper annular floating piston assembly at the upper end of said first annular chamber;

a lower annular floating piston assembly at the lower end of said first annular chamber;

pressurized inert gas in said first annular chamber between said upper and lower annular floating piston assemblies;

valve means on the upper end of said cylindrical body for controlling fluid communicating between said well annulus and the upper annular floating piston assembly such that when said valve means is open said upper annular floating piston assembly is exposed to said well annulus pressure;

annulus pressure responsive piston means in said second annular chamber responsive to well annulus pressure for slidable movement in said second annular chamber in response to changes in said well annulus pressure;

hydraulic oil located between said lower annular floating piston assembly and said annulus pressure responsive piston means such that movement of said annulus pressure responsive piston means will transfer a portion of said hydraulic oil between the lower portion of said first annular chamber and the upper portion of said second annular chamber through said communicating flow passage; and hydraulic impedance means and check valve means in said communicating flow passage for impeding displacement of hydraulic oil from said second annular chamber to said first annular chamber, and for allowing free passage of hydraulic oil from said first annular chamber to said second annular chamber.

7. The apparatus of claim 6 further comprising a shuttle valve in said first annular chamber between said upper and lower floating piston assemblies for selectively isolating the pressure of said inert gas in the upper portion of said first annular chamber from said lower annular floating piston assembly, said hydraulic oil, and said annulus pressure responsive piston means, thereby facilitating separation of the apparatus between said shuttle valve and said lower floating piston assembly without loss of said inert gas pressure.

8. The apparatus of claim 6 further comprising an annular inert gas filler valve in the exterior wall of said cylindrical body operable by selective application of hydraulic pressure for communicating pressurized inert gas with said first annular chamber.

9. In an apparatus for use in a tool string in an oil well for providing axial movement within said tool string responsive to applications of fluid pressure increases in the well annulus, and having an inert gas chamber within said apparatus, pressurized inert gas within said chamber for supplying a spring force within said apparatus, and piston means responsive to changes in the fluid pressure in the well annulus for moving in a first axial direction in response to increases in well annulus pressure and for moving in a second axial direction in response to the restoring force of said pressurized gas when the well annulus pressure increases are removed; the improvement comprising a shuttle valve means between said inert gas chamber and said piston including a flow channel for providing communication between the inert gas chamber and the piston means, having a pump-open port and a pump-closed port in the wall of said shuttle valve, and a sleeve valve member having a first differential area communicating with said pump-open port for moving said sleeve valve member to a first position wherein said flow channel is opened responsive to selective application of hydraulic pressure through said pump-open port, and a second differential area communicating with said pump-closed port for moving said sleeve valve member to a second position wherein said flow channel is closed responsive to selective application of hydraulic pressure through said pump-closed port, for selectively isolating said pressurized inert gas in said inert gas chamber from said piston means.

* * * * *

UNITED STATES PATENT AND TRADEMARK OFFICE

CERTIFICATE OF CORRECTION

PATENT NO. : 3,964,305

DATED : June 22, 1976

INVENTOR(S) : Gary Q. Wray and John C. Holden

It is certified that error appears in the above-identified patent and that said Letters Patent are hereby corrected as shown below:

Column 6, line 5, the number "26" should be --25--

Column 8, line 28, the number "322a" should be --332a--

Column 8, line 57, after have insert --been--

Column 12, line 36, after power insert --section--

Column 13, line 66, after outward insert --past--

Column 14, line 18, after biasing insert --spring--

Signed and Sealed this

Fifth Day of October 1976

[SEAL]

*Attest:*

RUTH C. MASON
*Attesting Officer*

C. MARSHALL DANN
*Commissioner of Patents and Trademarks*